252-99 AU 166 EX
4/5/83 XR 4,379,069

United States Patent [19]
Rapisarda et al.

[11] 4,379,069
[45] Apr. 5, 1983

[54] DETERGENT POWDERS OF IMPROVED SOLUBILITY

[75] Inventors: Anthony A. Rapisarda, Elmhurst, N.Y.; Joseph Romeo, Bergenfield; Jose A. Lopez, Palisades Park, both of N.J.

[73] Assignee: Lever Brothers Company, New York, N.Y.

[21] Appl. No.: 270,319

[22] Filed: Jun. 4, 1981

[51] Int. Cl.[3] ..... C11D 7/00
[52] U.S. Cl. ..... 252/135; 252/99; 252/174.14; 252/174.21; 252/DIG. 2; 252/DIG. 12
[58] Field of Search ..... 252/99, 135, 174.14, 252/174.21, DIG. 2, DIG. 12

[56] References Cited

U.S. PATENT DOCUMENTS

| | | | |
|---|---|---|---|
| 3,306,858 | 2/1967 | Oberle | 252/99 |
| 3,544,473 | 12/1970 | Kitchen et al. | 252/99 |
| 3,600,317 | 8/1971 | Lintner | 252/99 |
| 4,191,661 | 3/1980 | Halas et al. | 252/103 |
| 4,233,171 | 11/1980 | McLaughlin | 252/99 |

FOREIGN PATENT DOCUMENTS

| | | |
|---|---|---|
| 10822 | 5/1980 | European Pat. Off. . |
| 2743910 | 4/1978 | Fed. Rep. of Germany . |

*Primary Examiner*—John E. Kittle
*Assistant Examiner*—Hoa Van Le
*Attorney, Agent, or Firm*—Milton L. Honig; James J. Farrell

[57] ABSTRACT

The present invention relates to a powder detergent composition of improved solubility and methods of making them. The composition comprises a silicate free alkaline blend consisting essentially of about 10–60% builder, about 0.6–6% surfactant. about 20–50% alkaline agent and 0–70% filler; and an admixture of said blend with about 10–30% of solid alkali metal silicate and a chlorine donor providing about 0.4–1.5% available chlorine, the pH of the resulting finished product being about 10.4 or greater at about a 0.25% product use concentration.

9 Claims, No Drawings

DETERGENT POWDERS OF IMPROVED SOLUBILITY

The present invention relates generally to detergents. More particularly, it relates to detergent powders of improved solubility and methods of making them.

Among the common problems encountered in detergent powder formulations are the product solubility, stability and the free flow properties. Detergent powders having one or more of desirable characteristics have been formulated, e.g., U.S. Pat. No. 3,600,317 discloses a free flowing, non-caking dishwashing detergent using aluminum acetate as one of the essential ingredients. However, such formulations still suffer from a relatively high degree of insoluble residue as revealed by the tests described herein. Solubility of the product in water, it may be emphasized, is an important criterion for product acceptability by the consumer, as well as by the industry.

Insoluble residue is usually manifested in the form of distinct particles or as an opaque film on the surface of dinnerware rendering them unsightly with spots and/or films which are particularly prominent on the smooth surfaces of such articles as drinking glasses, dinner plates, etc. In addition to the aesthetic aspects, a severe build-up of insoluble product residue over a period of time may cause obstruction of the spray nozzles and/or filters of the dishwasher thereby reducing the optimal performance of the dishwashing machine. When the insoluble matter is due to the degradation of silicates, china-overglaze, metallic surface protection and detergency are also adversely affected.

Furthermore, preparing detergent powders by a conventional agglomeration process requires the steps of multiple screening and batch conditioning, which are energy and time consuming. The use of a mechanical blending process, on the other hand, as employed in the present invention, reduces the aforesaid energy and time consuming steps thereby offering a margin for cost reduction, increased productivity and energy savings in addition to producing a better product.

Accordingly, an object of the present invention is to overcome or reduce the disadvantages of the prior art methods.

It is another object to provide a process for making mechanically mixed detergent powders of improved solubility.

A further object is to produce detergent powders having good stability and free flow properties.

Other objects and advantages will appear as the description proceeds.

The attainment of the above objects is made possible by this invention which includes preparing a silicate free alkaline blend consisting essentially of, in percent by weight of the finished product, about 10-60% builder, about 0.6-6% surfactant, about 20-50% alkaline agent and 0 to about 70% filler, and thereafter mixing said blend with about 10-30% solid alkali metal silicate and a chlorine donor providing about 0.4-1.5% available chlorine, the pH of the resulting product being about 10.4 or greater at about 0.25% product use concentration.

In the preparation of detergent powders according to this invention, the order of raw material addition and the pH are critical. Acceptable solubility ratings are attained at a final product pH of about 10.4 or greater at a use concentration of about 0.25%. To achieve acceptable product solubility, the mixing order requires that the solid silicate be added after an alkaline mix comprising one or more of the components from the group consisting of a builder, a surfactant, a filler and an alkaline agent, preferably soda ash, are well blended. The solid silicate may also be added with the soda ash after blending in the surfactant. Optional ingredients , e.g., dyes, brighteners, fragrance, and the like may be blended at any time during the process but preferably after the addition of silicates. Chlorine donors or other bleaching agents are best added at the end.

A typical detergent composition indicating the ingredients and their relative proportions employed according to the present invention is set forth in Table 1.

TABLE 1

RAW MATERIAL COMPOSITION FOR A DRY MIX DETERGENT FORMULA

| Component | Percent by weight | |
|---|---|---|
| | Range | Preferred Concentration |
| Builder | 10-60 | 20-35 |
| Surfactant | 0.6-6.0 | 2.0-4.0 |
| Soda Ash | 20-50 | 30-40 |
| Sodium bicarbonate | 0-50 | 0 |
| Solid silicate | 10-30 | 12-20 |
| Chlorine donor | a | a |
| Filler | as needed | 10-30 |
| $H_2O$ | as needed | 8 |

[a]providing about 0.4% to 1.5% available chlorine, preferably one which is stable under low moisture conditions, e.g., sodium or potassium dichloroisocyanurate.

Builders of various types, organic, inorganic, ion exchangers, phosphate and nonphosphate containing, e.g., sodium carbonate, trisodium phosphate, tetrasodium pyrophosphate, sodium aluminosilicate, sodium tripolyphosphate, sodium citrate, sodium carboxymethyloxysuccinate, nitrilotriacetate, aluminosilicates and the like, are well known in the art and any one of them suitable for a detergent composition may be used. We prefer to employ anhydrous sodium tripolyphosphate from the group of phosphate containing builders and trisodium carboxymethyloxy succinate or sodium citrate from the non-phosphate group of builders (see examples below for specific formulations). It should be noted that when anhydrous sodium tripolyphosphate is used, sufficient water is added to substantially hydrate all of the anhydrous phosphate. This addition of water is not necessary when the non-phosphate builders mentioned above are used in which case sodium sulphate replaces water.

Similarly, surfactants or wetting agents of various types, anionic, nonionic, cationic or amphoteric, e.g., alkyl sulfate, ethoxylated alcohol, alkanolamides, soaps, linear alkylate sulfonate, alkyl benzene sulfonate, linear alcohol alkoxylate, ethylene oxide-propylene oxide block polymers and the like, are well known in the art and any one of them suitable for a detergent composition may be used. We prefer to employ the nonionic type from the "Pluronic" series of ethylene oxide-propylene oxide block polymers or from "Polytergent" group of linear alcohol alkoxylates. It may be noted, however, that in a dishwasher product non-foaming or low-foaming detergents used alone or in combination with an anti-foaming agent (e.g., monostearyl acid phosphate, stearic acid, etc.) are required because detergents which foam can result in suds overflow from the machine.

Alkaline agents are defined herein as those compounds selected from the group consisting of alkali metal carbonate, bicarbonate, hydroxide and mixtures thereof.

Among the bleaching and chlorine donor or active-chlorine containing substances suitable for use in a detergent composition, there may be mentioned those oxidants capable of having their oxygen or chlorine liberated in the form of free elemental oxygen or chlorine under conditions normally used for detergent bleaching purposes, such as potassium persulate, ammonium persulfate, sodium perborate, lauroyl peroxide, sodium peroxide, ammonium dipersulfate, potassium dichloroisocyanurate, sodium dichloroisocyanurate, chlorinated trisodium phosphate, calcium hypochlorite, lithium hypochlorite, monochloramine, dichloramine, nitrogen trichloride, [(mono-trichloro)-tetra-(monopotassium dichloro)]-penta-isocyanurate, 1,3-dichloro-5,5-dimethyl hydantoin paratoluene sulfondichloroamide, trichloromelamine, N-chloromelamine, N-chlorosuccinimide, N,N'-dichloroazodicarbonamide, N-chloroacetyl urea, N,N'-dichlorobiuret, chlorinated dicyandiamide, trichlorocyanuric acid, and dichloroglycoluril. Suitable chlorine-releasing agents are also disclosed in the ACS Monogram entitled "Chlorine—Its Manufacture, Properties and Uses" by Sconce, published by Reinhold in 1962, and may be employed in the practice of this invention. We prefer to use sodium dichloroisocyanurate (Clearon) in the formulations disclosed herein.

Fillers are also well known in the art. We prefer to use sodium sulfate but others, e.g. sodium chloride, etc., may be equally well employed.

To determine the solubility of the prepared formulation, tests were conducted by adding 2.5 grams of the test formulation to 1000 ml of distilled water heated to 100° F. in a 1500 ml beaker. The heated water was continuously stirred for 7 minutes, the speed of the stirring motor being adjusted to between 150 and 160 rpm and the height of the stirrer blade (1.75" diameter—30°-45° pitch) being maintained at about one inch off the bottom of the beaker. At the end of the seven minutes, the stirrer was removed and if any undissolved material appeared to be settling out in the beaker, the mixture was stirred with a stirring rod to get the insoluble material back in suspension and then immediately filtering the mixture with the aid of suction, through a black cloth disc (5 inch diameter) placed on the perforated disc of a Buchner funnel of appropriate size. Two to three minutes after all the transferred liquid in the Buchner funnel had passed through the black cloth, the black cloth was removed and the amount of residue, if any, remaining on the black cloth was qualitatively compared with a predetermined set of standards with the ratings as set forth in Table 2.

TABLE 2

| SOLUBILITY RATINGS | |
|---|---|
| Rating | Amount of Residue on Black Cloth |
| 0 | No residue |
| 1 | Very slight residue |
| 2 | Slight residue |
| 3 | Moderate residue |

TABLE 2-continued

| SOLUBILITY RATINGS | |
|---|---|
| Rating | Amount of Residue on Black Cloth |
| 4 | Heavy residue |
| 5 | Extremely insoluble |

Where the amount of residue on the black cloth is greater or less than that on the predetermined set of standards, an intermediate rating, e.g., 0.5, 1.5 and the like, based on visual comparison, is assigned. Care must be exercised in determining the solubility ratings because on an equal weight basis, finer particles, such as those obtained from mechanically mixed (dry mix) formulations, cover a larger surface area and show higher contrast (higher rating) than an equivalent weight of coarser particles such as those obtained from agglomerated type formulations. As an illustration, a representative comparison may be effected by way of isolating various particle sizes (via screening) of a water-insoluble material such as sand to be deposited on respective black cloths in gravimetrically equivalent amounts either by (a) directly weighing 0.01 g of the insoluble matter on the black cloth for the various particle sizes or (b) by vacuum filtering through respective black cloths 0.01 g of the insoluble particles in the form of a suspension.

Typical ratings obtained from random panelists are shown below:

| Particle size μ | Solubility rating | gms insoluble matter/cloth |
|---|---|---|
| 850-1400 | 0-1 | 0.01 |
| 500-850 | 2 | 0.01 |
| 250-500 | 2+ | 0.01 |
| 150-250 | 3 | 0.01 |

A determination of the particle size may also be conveniently made under the low power of an ordinary microscope.

Solubility breakdown studies were conducted on sample formulations packed in conventional aluminum foil wrapped cardboard boxes. The study was subsequently confirmed in sealed glass jars to eliminate the possible effect on solubility of such atmospheric variables as humidity and carbon dioxide. The solubility breakdown rate for the various raw material addition sequences were evaluated as a function of temperature at 1, 2, 3, 4 and 8 weeks storage at 125°, 95°, 80° and ambient temperatures. At the end of each specified period, the test samples were subjected to the solubility test described above and the solubility ratings determined.

In order to determine the desirable order of mixing various ingredients, solubility ratings of dry mixed formulations prepared by changing the sequence of addition of various components as set forth in Table 3, were performed. Usually a 1 to 2 kg batch of the formulation was made. Mixing was accomplished in the laboratory by using a commercial cake mixer, e.g., a Kitchen Aid or a Twin Shell laboratory blender.

TABLE 3

| SEQUENCE OF ADDITION OF DRY MIX DETERGENT COMPONENTS | | | | |
|---|---|---|---|---|
| | | Sequence | | |
| Component | % | A | B | C |
| NaTPP (Anhy. Sodium tri-polyphosphate | 24 | NaTPP | NaTPP | NaTPP |

TABLE 3-continued

SEQUENCE OF ADDITION OF DRY MIX DETERGENT COMPONENTS

| | Component | % | Sequence A | Sequence B | Sequence C |
|---|---|---|---|---|---|
| Dry Charge | Sodium silicate (Britesil H-24)* | 14 | Britesil H-24 | — | Britesil H-24 |
| | $Na_2SO_4$ (sodium sulfate) | 14 | $Na_2SO_4$ | $Na_2SO_4$ | $Na_2SO_4$ |
| | $Na_2CO_3$ (soda ash) | 35 | — | — | $Na_2CO_3$ |
| | | | (Mix)** | (Mix) | (Mix) |
| Premix | Nonionics (Pluronics) | 3 | Nonionics | Nonionics | Nonionics |
| | $H_2O$ | 8 | $H_2O$ | $H_2O$ | $H_2O$ |
| | | | (Mix) | (Mix) | (Mix) |
| | $Na_2CO_3$ (soda ash) | 35 | $Na_2CO_3$ | $Na_2CO_3$ | — |
| | Clearon (sodium dichloro-isocyanurate) | 3 | Clearon | — | Clearon |
| | | | (Mix) | (Mix) | (Mix) |
| | Britesil H-24 (sodium silicate) | 14 | — | Britesil H-24 | — |
| | Clearon (sodium dichloro-isocyanurate) | 1.2 | — | Clearon | — |
| | | | (Mix) | (Mix) | (Mix) |

*any one of sodium silicate (viz., Britesil H-20, H-24, C-20, C-24, made by Philadelphia Quartz, Philadelphia, PA, may be used)

**mixing is done for about 10–20 minutes.

The process in essence consists of four main steps: (a) preparing a dry charge by mixing anhydrous sodium tripolyphosphate or other builder with sodium sulfate and other component(s) as indicated under the heading "Dry Charge" in Table 3; (b) adding a "premix" comprising nonionic surfactant and water, if needed, to the dry charge while stirring the dry charge (water will be needed, for instance, when anhydrous sodium tripolyphosphate is employed as a builder, whereas the "premix" will be made of only the nonionic surfactant without water when sodium citrate or sodium carboxymethyloxy succinate is used as a builder); (c) thoroughly blending the product obtained after step (b) with soda ash or other alkaline agent; and (d) preparing a final blend by admixing the product obtained after step (c) with solid silicate, chlorine donor and other components as indicated in Table 3. The solubility ratings of various formulations prepared by different sequential steps and their storage stability under various conditions of temperature are set forth in Table 4. Determination of free flow and non-caking properties is made by the conventional visual observation.

TABLE 4

SOLUBILITY RATING AND STORAGE STABILITY OF DRY MIXED FORMULATIONS PREPARED WITH VARIATIONS IN THE ORDER OF RAW MATERIAL ADDITION

| Storage Condition | | Solubility Rating Sequence A | Sequence B | Sequence C |
|---|---|---|---|---|
| Initial | | 0.5 | 0.5 | 0 |
| 1 week at | 125° F. | 2.5 | 0.5 | 0 |
| 2 weeks at | 125° F. | 3.5 | 1 | 1 |
| | 95° F. | 1.5 | 0.5 | 0.5 |
| | 80° F. | 0.5 | 0.5 | 0.5 |
| | Room Temperature | 0.5 | 0.5 | 0 |
| 3 weeks at | 125° F. | 3.5 | 1.5 | 1 |
| 4 weeks at | 125° F. | 4.5 | 1.5 | 1 |
| | 95° F. | 2.75 | 0 | 0.5 |
| | 80° F. | 1.5 | 0.5 | 0.5 |
| | Room Temperature | 1.5 | 0.5 | 0.5 |
| 8 weeks at | 125° F. | 5+ | 3 | 1.5 |
| | 95° F. | 2 | 0.5 | 0.5 |
| | 80° F. | 2 | 0 | 0.5 |
| | Room Temperature | 2.5 | 0 | 0.5 |
| Visual Observation: | | Free flowing | Free flowing | Free flowing |

TABLE 4-continued

SOLUBILITY RATING AND STORAGE STABILITY OF DRY MIXED FORMULATIONS PREPARED WITH VARIATIONS IN THE ORDER OF RAW MATERIAL ADDITION

| Storage Condition | Solubility Rating Sequence A | Sequence B | Sequence C |
|---|---|---|---|
| Non-caking | Non-caking | Non-caking | Non-caking |

The results in Table 4 indicate that those order of raw material addition, viz., sequences B and C, yield a free flowing, non-caking powder retaining acceptable solubility even after two months storage, where the addition of silicate is made after or in combination with an alkaline agent, e.g., soda ash, into the formulation. The results further show that a basic requirement for obtaining a stable, soluble product is to minimize direct contact between the nonionics/$H_2O$ premix and the solid silicates.

Without being bound to any theory, it is postulated that the nonionics/$H_2O$ premix being slightly acidic (pH≈2.5–3.0) may have a destabilizing effect on the alkaline solid silicate which probably disintegrates under acidic conditions and liberates insoluble silica as identified by x-ray diffraction study. This effect appears to be specific for solid silicates. Inclusion of soda ash in the formulation, prior to the addition of solid silicates, serves various purposes. Aside from its relatively limited function as a builder, soda ash provides alkalinity and bulk to the dry powder charge neutralizing the acidic nonionic/$H_2O$ premix as well as providing a physical barrier between the liquid premix and the solid silicate. Sequence B is preferable, however, over other sequences because this sequence offers the added advantage of not interfering with the available water needed to hydrate the tripolyphosphate since soda ash, which absorbs water, is added after the aqueous premix but before the incorporation of the solid silicate. It may be noted, however, that the solubility of the formulation is a function of the pH of the system and not of the type of alkaline agent used. Hence, although soda ash is preferred as an alkaline agent, other alkaline agents, e.g., sodium hydroxide, sodium bicarbonate, etc., may be equally well employed as long as the pH of the final product (0.25% solution) is ≧10.4. The relationship between the pH and product solubility for dry mixed formulations using solid silicate (Britesil H-20 or H-24), sodium tripolyphosphate and soda ash is shown in Table 5.

TABLE 5 pH v. SOLUBILITY FOR PREFERRED DRY DRY MIX FORMULA

| pH* | Solubility |
|---|---|
| 9.4 | 4.0 |
| 9.7 | 3.25 |
| 10.4 | 2.0 |
| 10.8 | 0 |

*pH was adjusted by changing the ratio of $Na_2CO_3/NaHCO_3$.

The presence of aluminum acetate, as taught by the U.S. Pat. No. 3,600,316, was found to be detrimental to the product solubility. Table 6 shows the effect of aluminum acetate on solubility ratings of preferred compositions according to the U.S. Pat. No. 3,600,316 and according to the present invention.

TABLE 6

EFFECT OF ALUMINUM ACETATE ON PRODUCE SOLUBILITY

| | Preferred Composition According to U.S. Pat. No. 3,600,317 | Preferred Composition According to Present Invention | |
|---|---|---|---|
| Order of Addition | | | |
| NaTPP (anh.) | 54.00 | 24.00 | 24.00 |
| $H_2O$ | 1.10 | — | — |
| Triton CF-10 | 4.00 | — | — |
| $H_2O$ | — | 7.85 | 7.85 |
| Pluronic L61 and L62 plus anti-foaming agent | — | 3.09 | 3.09 |
| Na metasilicate (anh.) | 16.00 | — | — |
| Britesil H-24 (as is) | — | 13.70 | 13.70 |
| $Na_2CO_3$ | 23.00 | 35.00 | 35.00 |
| $Na_2SO_4$ | — | 15.20 | 13.00 |
| Chlorine donor | 1.00 | 1.2 | 1.2 |
| Aluminum acetate basic | 1.00 | — | 2.00 |
| Solubility Ratings | | | |
| Initial | 3 | 0 | 3 |
| 3 weeks Room Temp. | 3 | 0 | 3.25 |
| 95° F. | 3.25 | 0–1 | 3.25 |
| 125° F. | 3.25 | 2.5 | 4 |

The results indicate that poor solubility ratings are obtained when aluminum acetate is used in the formulation. It should be noted that according to the teaching of the present invention a soluble, free flowing, non-caking, dry mix detergent powder is obtained without the use of aluminum acetate. It may also be pointed out that although highly alkaline and more soluble metasilicate may be employed in the preparation of a detergent powder according to our invention, we prefer the use of less toxic Britesil H-20, H-24, C-20 or C-24.

The following examples will more fully illustrate the embodiments of this invention. All parts and proportions referred to herein and in the appended claims are by weight unless otherwise indicated.

EXAMPLE I

A free-flowing, non-caking, dry mix, phosphate containing automatic dishwasher detergent powder composition is obtained by adopting the sequence and proportion of mixing the ingredients as set forth in Table 7.

TABLE 7

DRY MIXED PHOSPHATE CONTAINING AUTOMATIC DISHWASHER FORMULATION

| | Order of Raw Material Addition | | % |
|---|---|---|---|
| Dry Charge | Anhy. Sodium tripolyphosphate | | 24.00 |
| | Sodium sulfate | | 15.0 |
| | | (Mix) | |
| Premix | Nonionic surfactant (Pluronic L 62D) | | 3.1 |
| | Water | | 8.0 |
| | | (Mix) | |
| | Soda Ash | | 35.0 |
| | | (Blend) | |
| | Sodium silicate (Britesil H-24, as is) | | 13.7 |
| | Sodium dichloroiso-cyanurate | | 1.2 |
| | | (Mix) | |
| | Initial Solubility rating | | 0 |
| | Solubility rating after 2 months at 95° F. | | 0–1 |

A desirable product with solubility ratings between 0 and 1 after 2 months storage is obtained by first preparing a dry-charge by mixing the anhydrous sodium tripolyphosphate and sodium sulfate in the proportions shown in Table 7. The dry-charge is then blended with a pre-mix prepared by mixing the nonionic surfactant with water in the indicated proportions (Table 7). Soda ash is now added to the mixture resulting from the blending of the dry-charge and the pre-mix and the components are again thoroughly blended. Thereafter, sodium silicate and the bleaching (chlorinating) agents and other optional components, e.g., fragrance, colorants, etc., are added and the final product obtained by thorough mixing of all ingredients.

EXAMPLE II

A free flowing, non-caking, dry mix, non-phosphate (citrate) containing automatic dishwasher detergent powder composition is obtained by adopting the sequence and proportion of mixing the ingredients as set forth in Table 8.

TABLE 8

DRY MIXED, NON-PHOSPHATE, (CITRATE) CONTAINING AUTOMATIC DISHWASHER FORMULATION

| Order of Raw Material Addition | | % D | % E | % F | % G |
|---|---|---|---|---|---|
| Sodium sulfate | | 16.9 | 15.4 | 16.9 | 15.9 |
| Sodium carbonate | | 35 | 35 | 35 | 35 |
| | (mix) | | | | |
| Nonionic surfactant (Pluronic L 62D) | | 4.5 | 6.0 | — | — |
| Nonionic surfactant (Polytergent SLF-18) | | — | — | 4.5 | 6.0 |
| | (mix) | | | | |
| Sodium polyacrylate | | 3.0 | 3.0 | 3.0 | 3.0 |
| Sodium citrate | | 24.0 | 24.0 | 24.0 | 24.0 |
| | (mix) | | | | |
| Sodium silicate (Britesil H-20, used as is) | | 12.0 | 12.0 | 12.0 | 12.0 |
| Sodium dichloroiso-cyanurate | | 1.5 | 1.5 | 1.5 | 1.5 |
| Miscellaneous* to make 100% | | | | | |
| | (mix) | | | | |
| Initial Solubility rating | | 0 | 0 | 0 | 0 |
| Solubility rating after 2 months at 95° F. | | 0 | 0 | 0–1 | 0–1 |

*Miscellaneous includes water of hydration, perfumes, etc.

EXAMPLE III

A free flowing, non-caking, dry mix non-phosphate (CMOS) containing automatic dishwasher detergent powder composition is obtained by adopting the sequence and proportion of mixing the ingredients as set forth in Table 9.

TABLE 9

DRY MIXED NON-PHOSPHATE (CMOS) CONTAINING AUTOMATIC DISHWASHER FORMULATION

| Order of Raw Material Addition | | % |
|---|---|---|
| Trisodium carboxymethyloxy-succinate (CMOS) | | 24.0 |
| Sodium carbonate | | 35.0 |
| Sodium sulfate | | 10.6 |
| | (mix) | |
| Nonionic surfactant (Pluronic L 61) | | 4.5 |
| | (mix) | |
| Sodium silicate (Britesil H-24, as is) | | 13.7 |
| Sodium dichloroisocyanurate | | 1.2 |
| Sodium polyacrylate | | 3.0 |
| Water (CMOS is a hydrate) | | 8.0 |
| | (mix) | |
| Initial solubility rating | | 0–1 |
| Solubility rating after 2 months at 95° F. | | 0–1 |

It is understood that either a batch or a continuous mode of operation using conventional equipment or machines and a spray or a drip method of incorporating the premix in the dry charge, etc., may be conveniently employed in the practice of this invention. Also, the formulations may be produced in various forms or sizes, e.g., granules or tablets, etc., and such formations are contemplated within the scope of this invention.

It is also understood that the examples and embodiments described herein are for illustrative purposes only and that various modifications or changes in the light thereof will be suggested to persons skilled in the art and are to be included within the spirit and preview of this application and the scope of the appended claims.

We claim:

1. A process for making a powder detergent of improved solubility, comprising the steps of:

(1) preparing a silicate free alkaline blend consisting essentially of, in percent by weight of the finished product, about 10–60% builder, about 0.6–6% surfactant, about 20–50% alkaline agent and 0 to about 70% filler; and (2) thereafter mixing said blend with about 10–30% solid alkali metal silicate and a chlorine donor providing about 0.4–1.5% available chlorine, the pH of the resulting product being about 10.4 or greater at about 0.25% product use concentration.

2. A process as defined in claim 1 wherein said builder is selected from the group consisting of anhydrous sodium tripolyphosphate, sodium citrate, trisodium carboxymethyloxy succinate, nitrilotriacetate and mixtures thereof.

3. A process as defined in claim 2 wherein the amount of said builder is about 24%.

4. A process as defined in claim 1 wherein said surfactant is added as a premix of water and a nonionic wetting agent when said builder is an anhydrous salt of sodium tripolyphosphate.

5. A process as defined in claim 4 wherein the amount of water used is sufficient to substantially completely hydrate all of the anhydrous sodium tripolyphosphate.

6. A process as defined in claim 4 wherein said nonionic wetting agent is selected from the group consisting of ethylene oxide propylene oxide block copolymers, linear alcohol alkoxylates and mixtures thereof.

7. A process of making a detergent powder of improved solubility, comprising the steps of:

(1) preparing a silicate free blend consisting essentially of, in percent by weight of the finished product, about 24% of anhydrous sodium tripolyphosphate, about 15% sodium sulfate, about 35% soda ash, and a premix prepared by adding about 8% water to about 3% of a nonionic surfactant selected from the group consisting of polyoxyethylene polyoxypropylene block copolymers and linear alcohol alkoxylates; and (2) thereafter mixing said blend with about 13.8% sodium silicate, and about 1.5% sodium dichloroisocyanurate.

8. A process for making a detergent powder of improved solubility, comprising the steps of:

(1) preparing a silicate free blend consisting essentially of, in percent by weight, about 24% of a builder selected from the group consisting of sodium citrate and trisodium carboxymethyloxy succinate, about 16% sodium sulfate, about 35% soda ash, about 4.5%–6% nonionic surfactant, and about 3% sodium polyacrylate; and (2) thereafter mixing said blend with about 13% solid sodium silicate and about 1%–2% sodium dichloroisocyanurate.

9. A composition made by the process of claim 1, 7 or 8 wherein the solid alkali metal silicate is less alkaline than metasilicate.

* * * * *